US009163888B1

(12) United States Patent
DiOrio

(10) Patent No.: US 9,163,888 B1
(45) Date of Patent: Oct. 20, 2015

(54) REAR LOCK-UP RIMFIRE BOLT ACTION ASSEMBLY

(71) Applicant: Anthony Joseph DiOrio, Mount Solon, VA (US)

(72) Inventor: Anthony Joseph DiOrio, Mount Solon, VA (US)

( * ) Notice: Subject to any disclaimer, the term of this patent is extended or adjusted under 35 U.S.C. 154(b) by 0 days.

(21) Appl. No.: 14/672,151

(22) Filed: Mar. 28, 2015

Related U.S. Application Data

(60) Provisional application No. 61/973,774, filed on Apr. 1, 2014.

(51) Int. Cl.
*F41A 3/00* (2006.01)
*F41A 3/32* (2006.01)
*F41A 3/66* (2006.01)

(52) U.S. Cl.
CPC .... *F41A 3/32* (2013.01); *F41A 3/66* (2013.01)

(58) Field of Classification Search
CPC ..... F41A 3/26; F41A 3/66; F41A 3/12
USPC ..... 42/10–16
See application file for complete search history.

(56) References Cited

U.S. PATENT DOCUMENTS 1,331,154 A * 2/1920 Johnson ..... 42/16
1,344,991 A * 6/1920 Cunningham ..... 89/144
1,545,045 A * 7/1925 Dute ..... 42/16
1,631,242 A * 6/1927 Burton ..... 42/16
2,214,071 A * 9/1940 Swebilius ..... 42/17
2,424,264 A * 7/1947 Yorks ..... 89/185
2,490,922 A * 12/1949 Rutherford et al. ..... 42/16
3,330,061 A * 7/1967 Koon, Jr. ..... 42/16
3,494,216 A 2/1970 Haskins
3,745,686 A * 7/1973 Koon, Jr. ..... 42/16
3,979,849 A * 9/1976 Haskins ..... 42/16
5,228,887 A * 7/1993 Mayer ..... 42/75.02
5,410,834 A * 5/1995 Benton et al. ..... 42/75.02
6,000,161 A * 12/1999 Aalto ..... 42/16
6,508,025 B1 * 1/2003 Du Plessis ..... 42/16
7,975,417 B2 7/2011 Duplessis et al.
8,302,340 B1 * 11/2012 Irwin ..... 42/16
8,683,726 B1 4/2014 Genton
2015/0020423 A1 * 1/2015 Withey ..... 42/16

FOREIGN PATENT DOCUMENTS

GB 778083 A 7/1957

* cited by examiner

*Primary Examiner* — Samir Abdosh
(74) *Attorney, Agent, or Firm* — Law Office of Peter G. Korytnyk, PLLC

(57) ABSTRACT

A rear lock-up bolt action assembly is provided. The bolt action assembly can include a receiver body including a front aperture capable of receiving a firearm barrel and a rear aperture. A lug groove can be formed in the vicinity of the rear aperture of the receiver body. The bolt action assembly can also include a bolt assembly including a bolt handle and three rear locking lugs arranged on a rear portion of the bolt assembly. The bolt assembly is configured to be arranged in the receiver body such that the three rear locking lugs are capable of being rotated within the lug groove when the bolt handle is rotated. When a round is fired, the three rear locking lugs are forced to mate with the lug groove thereby evenly distributing a bolt pressure on the receiver body.

20 Claims, 5 Drawing Sheets

REAR LOCK-UP RIMFIRE BOLT ACTION ASSEMBLY

CROSS REFERENCE TO RELATED APPLICATION

The present application claims the benefit from earlier filed U.S. Provisional Patent Application No. 61/973,774, filed Apr. 1, 2014, which is incorporated herein in its entirety by reference.

FIELD OF THE INVENTION

The present teachings relate to a bolt action system for a firearm. In particular, the present teachings relate to a rimfire bolt action that can facilitate the precise positioning of the bolt and firing pin within the receiver in order to improve accuracy and ease of use of the firearm.

BACKGROUND OF THE INVENTION

There are a variety of known designs of bolt actions for rifles. A design objective of bolt actions is the precise alignment of a bolt face to a cartridge chamber to properly position the firing pin to strike the primer of a cartridge. To achieve precise and repeatable firing results during competition shooting, it is desirable to accurately secure the bolt mechanism in its proper position and keep it relatively immovable with respect to the cartridge and barrel during movement of the firing pin and the striking of the cartridge primer.

Moreover, due to the nature of high-powered rifles, the bolt mechanism is subjected to enormous stress as gas pressure caused by cartridge firing rapidly builds and expels the projectile from the barrel. In order to achieve precise accuracy during firing, it is critical that the axis of the bolt and the firing pin remain parallel with the axis of the bore of the firearm barrel while also providing a perpendicular surface to accept a cartridge head.

In competition shooting, rimfire cartridges are often used with a bolt action rifle. The forces generated by a rimfire cartridge are much less than a center fire cartridge. A rimfire cartridge, when fired, is traveling about a third of the speed of a center fire cartridge which means the bullet is in the barrel a longer period of time when compared to a center fire. The resulting lag time in the barrel exposes the bullet to vibrations created during the firing process and these vibrations affect the bullet's trajectory. It has been proven through extensive testing that a front lock-up bolt design generally used with center fire ammunition accentuates the vibrations experienced by rimfire cartridges due to the close proximity of the lugs to the case rim and the lag time, and is therefore considered detrimental to accuracy.

In addition, known rear lock-up bolt receivers distribute bolt pressure over a maximum of two contact points at the rear of the receiver. This results in the bolt assembly flexing and moving during the firing of a round. Such movement of the bolt assembly also prevents consistent positioning of the components of the bolt action thereby jeopardizing accurate, repeatable performance by the shooting competitor.

Bolt action rifles that fire rimfire cartridges incorporate an offset firing pin. A center fire cartridge has a replaceable primer located in the center of the cartridge and when struck by the centrally located firing pin, the primer creates a flash that ignites the gun powder. In contrast, a rimfire cartridge's primer is part of the case. More specifically, there is a fold of brass material at the rim of the rimfire cartridge that has a chemical compound applied to the area inside the case prior to the gun powder and bullet being installed in the cartridge. The firing pin of a rimfire bolt action assembly is offset and strikes the rimfire cartridge on the outer edge of the case. Due to the firing pin being off center, the bolt will experience a force that is shifted to one side and the bolt will move away from the force if not supported properly.

Accordingly, there exists a need for a rear lock-up rimfire bolt action assembly that can evenly distribute the forward pressure the bolt assembly places on a chambered round and will not allow the bolt assembly to move or flex within the action body during the firing of the round.

SUMMARY OF THE INVENTION

The present teachings provide a bolt action assembly including a receiver body having a front aperture capable of receiving a firearm barrel and a rear aperture. A lug groove is formed in the vicinity of the rear aperture of the receiver body. The bolt action assembly further includes a bolt assembly having a bolt handle and three rear locking lugs arranged on a rear portion of the bolt assembly. The bolt assembly is configured to be arranged in the receiver body such that the three rear locking lugs are capable of being rotated within the lug groove when the bolt handle is rotated.

The present teachings also provide a rear lock-up bolt action assembly including a receiver body having a lug groove formed in the vicinity of a rear portion of the receiver body. The lug groove defines a rear shoulder surface. The rear lock-up bolt action assembly further includes a bolt assembly including a bolt handle and at least three rear locking lugs arranged on a rear portion of the bolt assembly. Each of the at least three rear locking lugs defines a rear seating surface. The bolt assembly is configured to be supported in the receiver body such that when a round is fired the rear seating surfaces of each of the three rear locking lugs are forced to mate with the rear shoulder surface of the lug groove thereby evenly distributing a bolt pressure.

The present teachings still further provide a rear lock-up rimfire bolt action assembly including a receiver body including a lug groove formed in the vicinity of a rear portion of the receiver body. The rear lock-up rimfire bolt action assembly further includes a bolt assembly including an offset firing pin, a bolt handle, and at least three rear locking lugs arranged on a rear portion of the bolt assembly. The bolt assembly is configured to be supported in the receiver body such that when a rimfire cartridge is fired, the three rear locking lugs are forced to mate with the lug groove thereby evenly distributing a bolt pressure on the receiver body.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

Figure 1:
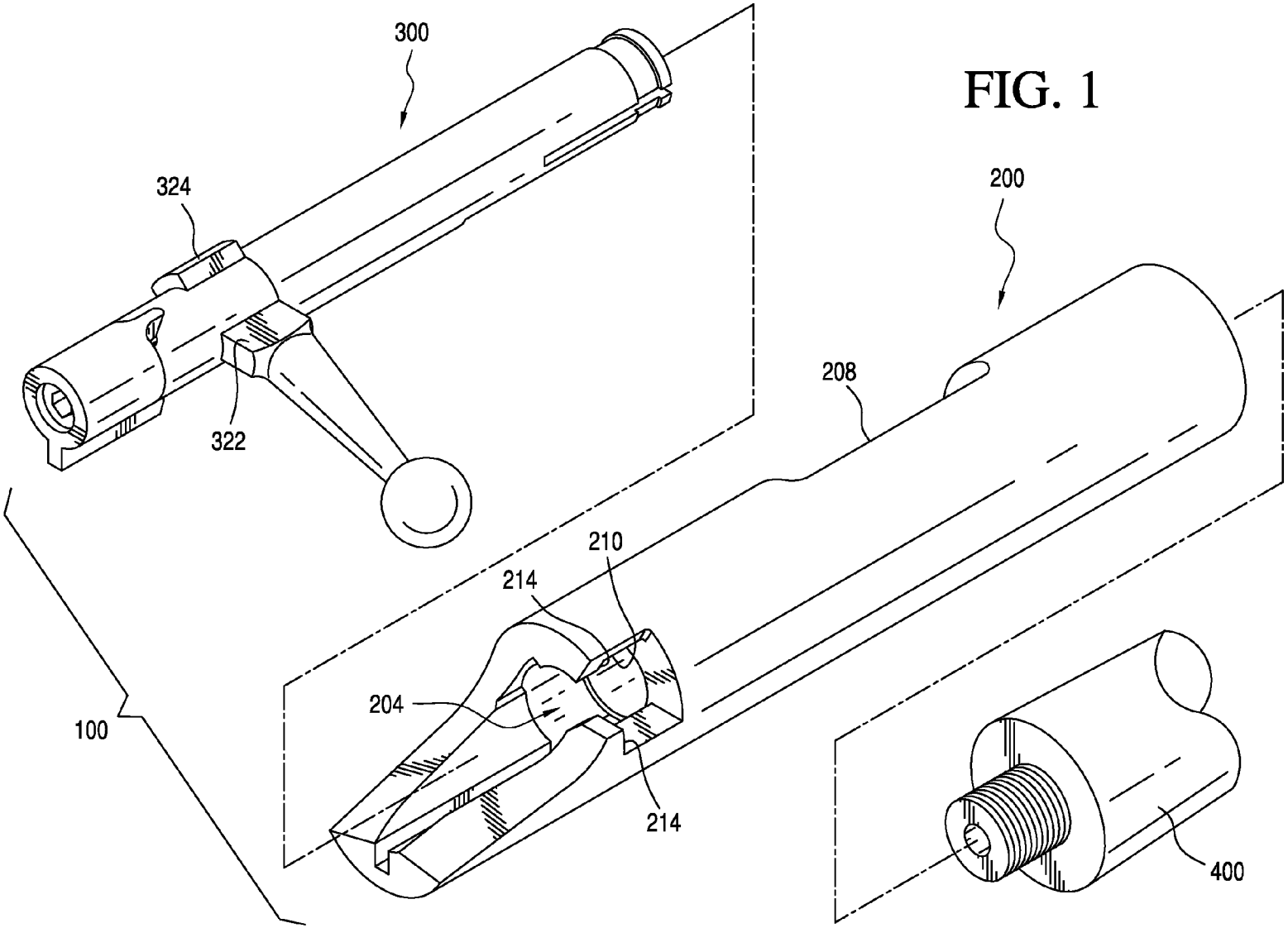
FIG. 1 shows an exploded perspective view of the bolt action assembly of the present teachings along with a firearm barrel.
Figure 2:
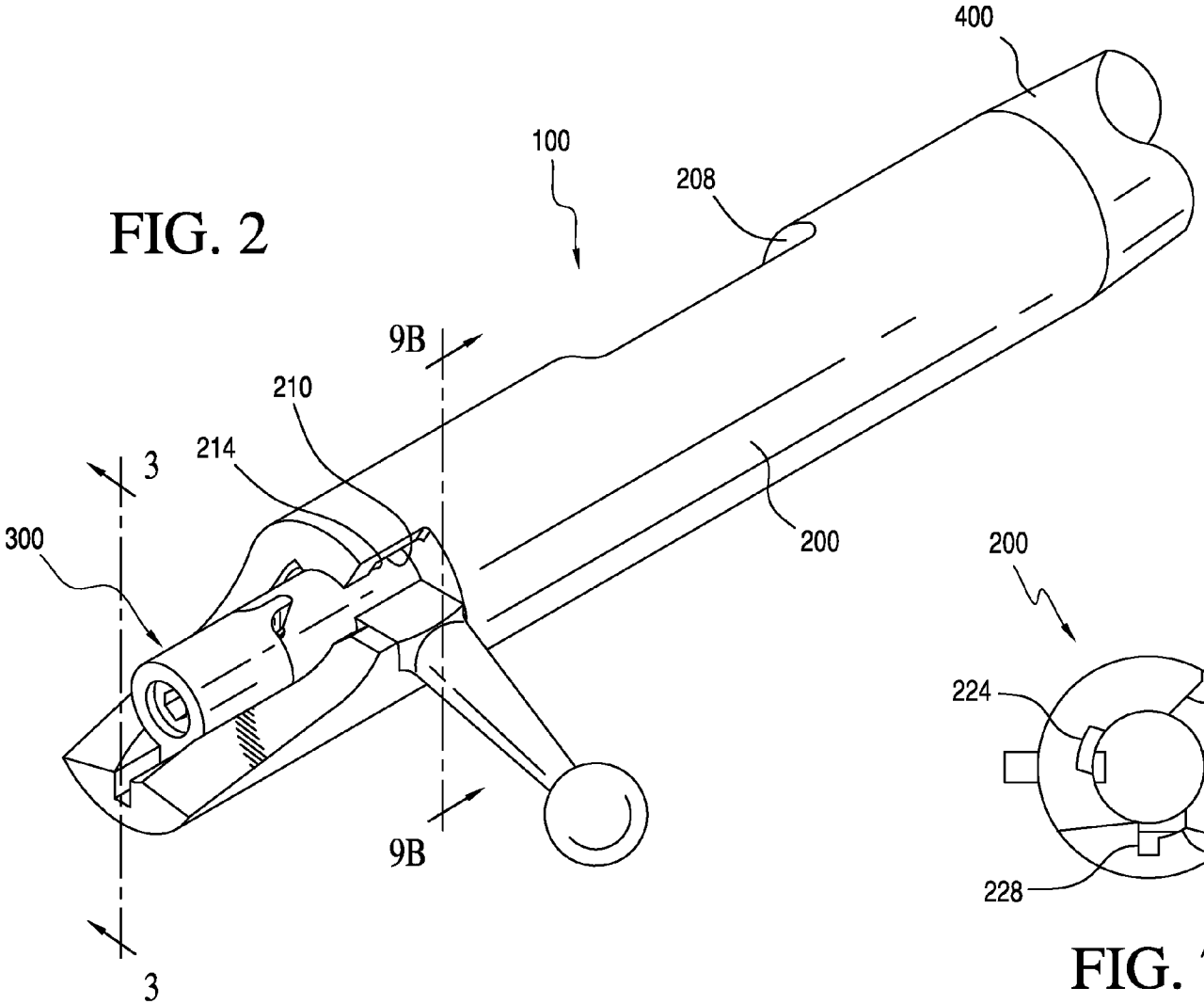
FIG. 2 shows a perspective view of the bolt action assembly of FIG. 1 in an assembled state.
Figure 3:
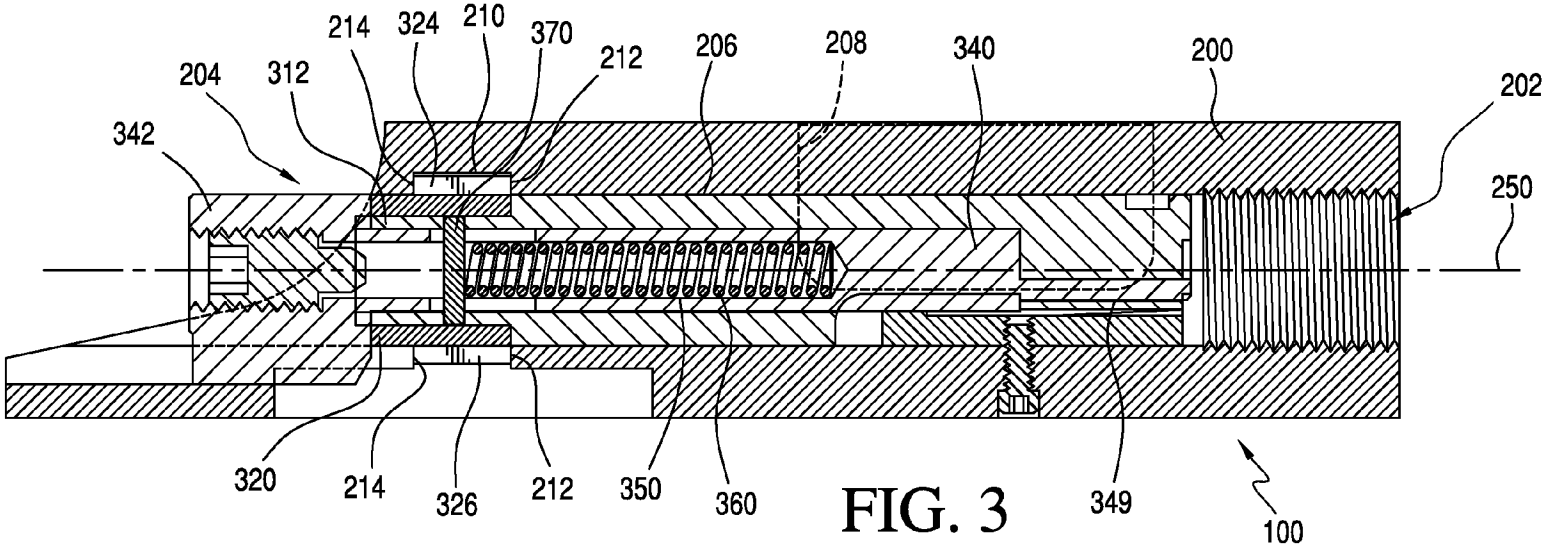
FIG. 3 shows a side cross-sectional view of the bolt action assembly taken through line 3-3 of FIG. 2.

Referring to FIGS. 1-3, a bolt action assembly 100 of the present teachings which is capable of being mounted onto a stock of a firearm is shown. The bolt action assembly 100 includes a receiver body 200 and a bolt assembly 300 that is adapted to be received within the receiver body 200. The receiver body 200 has a front aperture 202 that is concentric with and capable of being in communication with a barrel 400 of a firearm. The receiver body 200 has a rear aperture 204 through which bolt assembly 300 can be inserted and secured to the receiver body 200 in a cocked and uncocked position. The apertures 202, 204 are connected by a central bore 206 within receiver body 200. The receiver body 200 can include a loading port 208 into which a cartridge (not shown) can be inserted for loading into the breech of the firearm barrel (also not shown).

As will be discussed in more detail below, the receiver body 200 further includes a lug groove 210 that is located in the vicinity of the rear aperture 204 and is adapted to be engaged by three locking lugs 322, 324, 326 located on a rear portion of the bolt assembly 300. The lug groove 210 of the receiver body 200 and the complementary-shaped rear locking lugs 322, 324, 326 of the bolt assembly 300 permit a rear portion of the bolt assembly 300 to be securely held within the receiver body 200 and in a concentric manner with respect to the firearm barrel 400 thereby allowing accurate and repeatable firing of the firearm. The rearward location of the locking lugs 322, 324, 326 and of the lug groove 210 form a rear lock-up arrangement for the bolt action assembly 100 of the present teachings.

Figure 4:
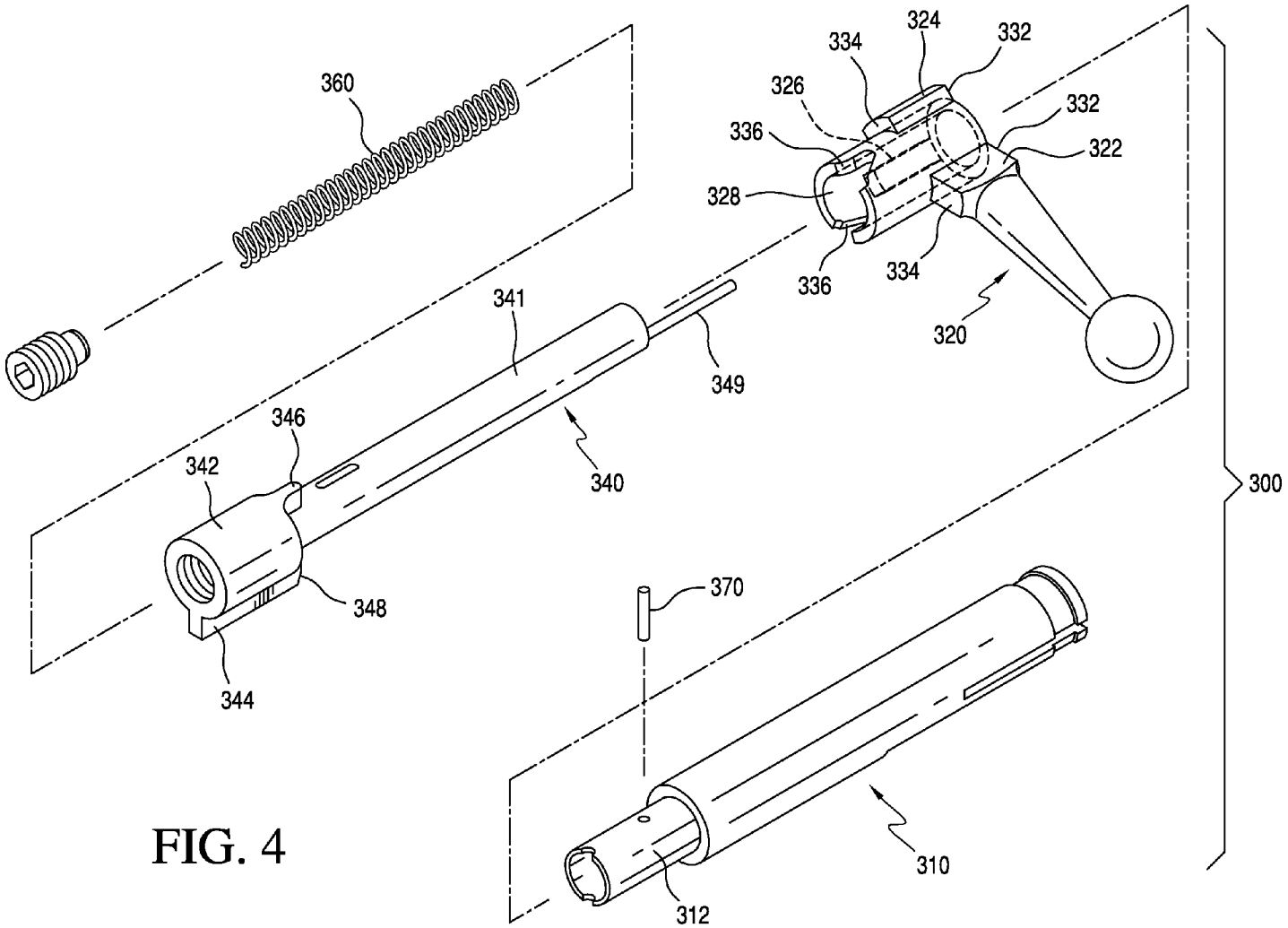
FIG. 4 shows an exploded perspective view of the bolt assembly of the present teachings.

Now referring to FIG. 4, the bolt assembly 300 includes a generally cylindrical bolt body 310, a bolt handle 320, and a firing pin slide 340. The bolt handle 320 can include a bore 328 that can be adapted to slide onto a rear reduced diameter portion 312 of the bolt body 310. A reduced diameter portion 341 of the firing pin slide 340 can extend through the bore 328 in the bolt handle 320 and can slide within the bolt body 310 with a tight tolerance. As will be discussed in more detail below, a firing spring 360 can be arranged to be held via a pin 370 within the firing pin slide 340 in a manner that resiliently forces the firing pin slide 340 against the bolt handle 320 which in turn is forced against the bolt body 310.

Figure 5:
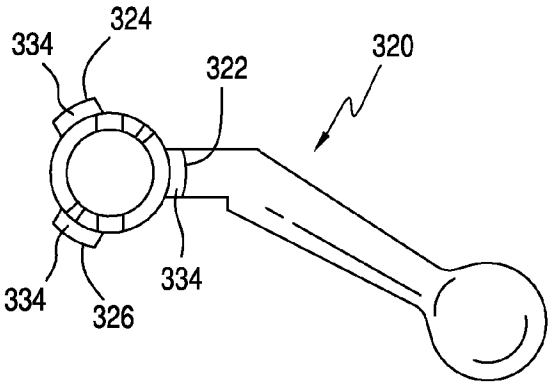
FIG. 5 shows an end view of the rearward end of the bolt handle of the present teachings.

As best shown in FIG. 5, the bolt handle 320 includes three rear locking lugs 322, 324, 326 that can each extend radially outwardly therefrom. One of the locking lugs 322 can be formed as part of the radially extending handle of the bolt handle 320. According to an exemplary embodiment, the three rear locking lugs 322, 324, 326 can be arranged equidistantly about the circumference of the bolt handle 320. While the present teachings disclose the use of three rear locking lugs 322, 324, 326, more than three rear locking lugs can be implemented with the bolt assembly 300 according to various embodiments. The use of additional rear lugs can further increase the even distribution of pressure on the bolt assembly 300 by the firing process of the round and further prevent the bolt assembly 300 from moving up, down, or side-to-side during the firing thereof.

Referring to FIGS. 3 and 4, the lug groove 210 of the receiver body 200 can accept each of the complementary-shaped locking lugs 322, 324, 326 of the bolt handle 320. For example, the lug groove 210 can include a substantially rectangular cross-section into which the locking lugs 322, 324, 326 can mate with a tight manufacturing tolerance allowing the locking lugs 322, 324, 326 to rotationally slide within the lug groove 210. Moreover, each locking lug 322, 324, 326 can include a front seating surface 332 and a rear seating surface 334. The lug groove 210 can include a corresponding front shoulder surface 212 and a rear shoulder surface 214. In use of the bolt action assembly 100 of the present teachings, each of the rear seating surfaces 334 of the locking lugs 322, 324, 326 are forced against and mate with the rear shoulder surface 214 of the lug groove 210.

Referring to FIG. 4, a rear portion of the firing pin slide 340 can include a cocking piece 342. The cocking piece 342 can include a tang 344 which can operate to ride onto a sear and trigger assembly (not shown) of the firearm. Opposite from the tang 344, the cocking piece 342 can include a cocking lobe 346. The tang 344 can also form a cocking lobe 348 at one end thereof. The cocking lobes 346, 348 can be forced into engagement with corresponding cam surfaces 336 of the bolt handle 320 via the firing spring 360.

The firing spring 360 can be arranged within a bore 350 formed in the firing pin slide 340. In an assembled condition of the bolt assembly 300, the firing spring 360 is held via a pin 370 within the firing pin slide 340 in a manner that resiliently forces the cocking piece 342 against the bolt handle 320 (which in turn is forced against the bolt body 310) thereby forcing the cocking lobes 346, 348 into engagement with the cam surfaces 336 of the bolt handle 320.

Figure 6:
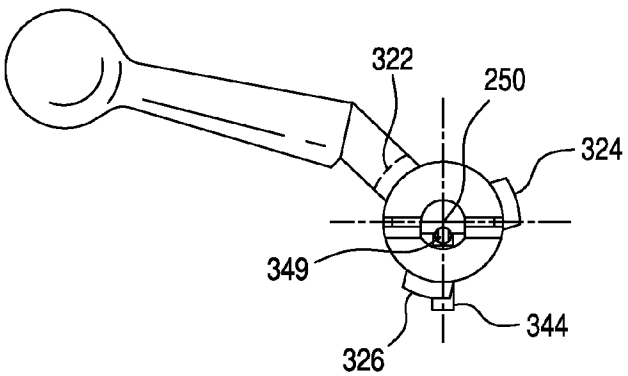
FIG. 6 shows an end view of the front portion of the bolt handle assembly of FIG. 4.

Referring to FIGS. 3, 4, and 6, a front portion of the firing pin slide 340 can include an offset firing pin 349. The bolt action assembly 100 of the present teachings is a rimfire receiver and the firing pin 349 is arranged offset with respect to the longitudinal axis 250 of the receiver body 200. The offset firing pin 349 allows a rimfire cartridge loaded into the bolt action assembly 100 to be struck on the outer edge of the case where the primer of the cartridge is located when the trigger of the trigger assembly (not shown) is pulled.

Figure 7:
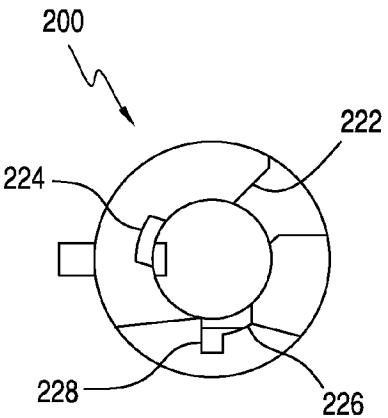
FIG. 7 shows an end view of the rear portion of the receiver body of FIG. 1.

Referring to FIG. 7, a rear portion of the receiver body 200 is formed with three complimentary-shaped lug raceways 222, 224, 226 that allow the locking lugs 322, 324, 326 of the bolt assembly 300 to be inserted into engagement with the lug groove 210 of the receiver body 200. Moreover, one of the lug raceways 226 can further include a tang raceway 228 that allows the tang 344 of the cocking piece 342 to slide into the receiver body 200 as the locking lugs 322, 324, 326 of the bolt assembly 300 are inserted into the receiver body 200. The tang raceway 228 also allows the tang 344 to ride onto the sear of the trigger assembly (not shown) as the bolt assembly 300 is inserted into the receiver body 200.

Prior to inserting the bolt assembly 300 into the receiver body 200, the bolt handle 320 must be in the fully open position. When the bolt handle 320 is in the fully open position, the firing pin spring 360 is in a compressed state. After the bolt assembly 300 is fully inserted into the rear portion of the receiver body 200, the bolt action assembly 100 of the present teachings can be cocked.

Figure 8B:
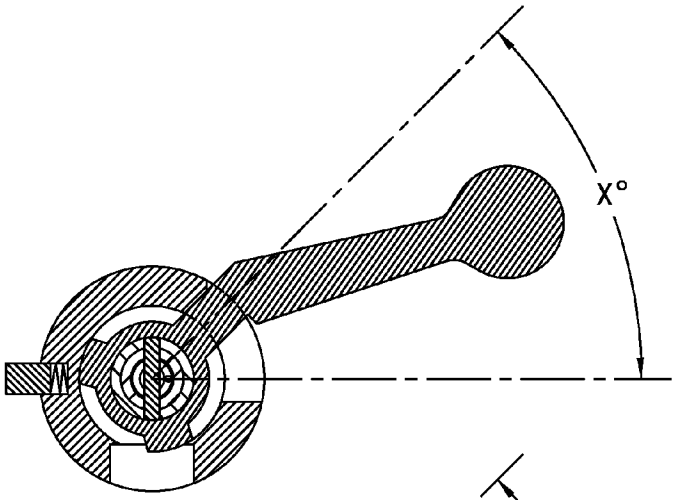
FIG. 8*b* shows an cross-sectional view of the rear portion of the bolt action assembly of the present teachings with the bolt handle in the fully open position.
Figure 9B:
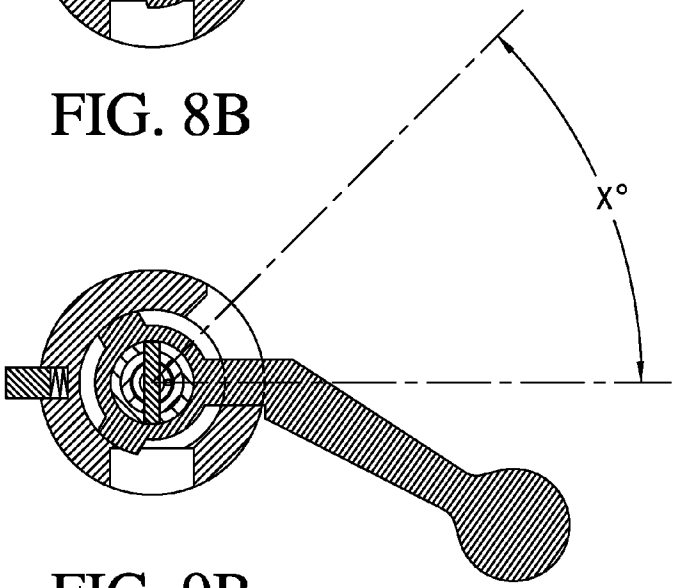
FIG. 9*b* shows a cross-sectional end view of the rear portion of the bolt action assembly of the present teachings taken through line 9B-9B of FIG. 2 with the bolt handle in the closed position.
Figure 8A:
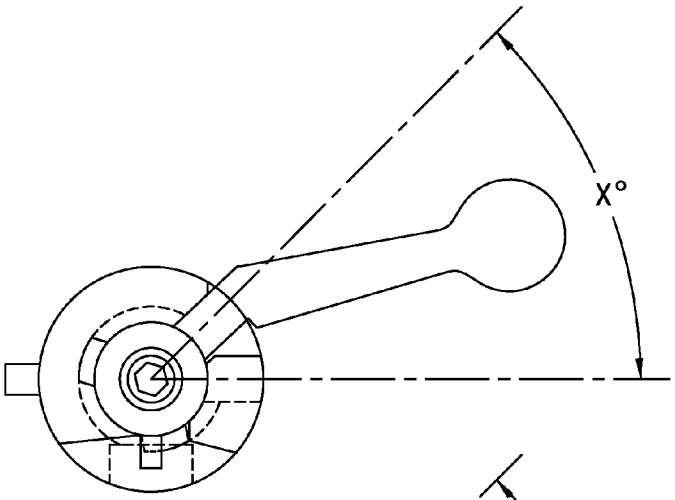
FIG. 8*a* shows an end view of the rear portion of the bolt action assembly of the present teachings with the bolt handle in the fully open position.
Figure 9A:
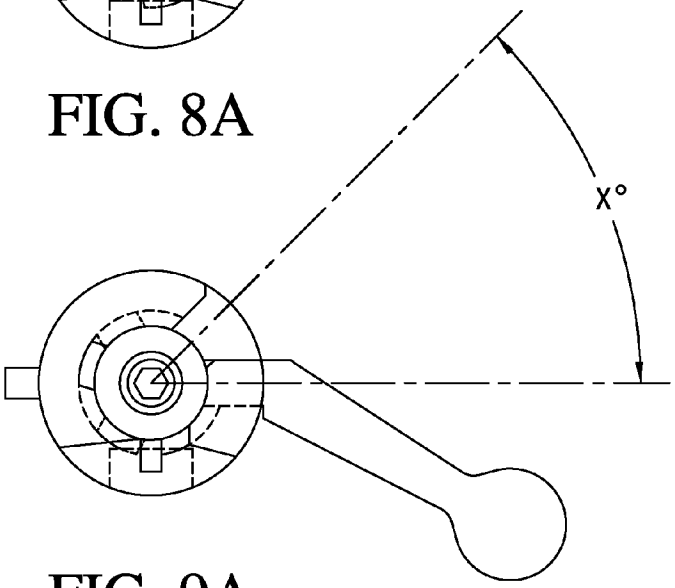
FIG. 9*a* shows an end view of the rear portion of the bolt action assembly of the present teachings with the bolt handle in the closed position.

Cocking the bolt action assembly 100 involves rotating the bolt handle 320 through an angular movement, X°, from a fully open position shown in FIGS. 8A and 8B to the fully closed position shown in FIGS. 9A and 9B.

As the bolt handle 320 is rotated from the fully open position to the fully closed position, the locking lugs 322, 324, 326 are also rotated within the lug groove 210 of the receiver body 200 into a position where the back seating surface 334 of each locking lug 322, 324, 326 is engaged and supported by the corresponding rear shoulder surface 214 of the lug groove 210.

During use, as the bolt handle 320 is rotated from the fully closed position to the fully open position, the cocking lobes 346, 348 of the cocking piece 342 are forced into engagement with the moving cam surfaces 336 of the bolt handle 320 which cocks the cocking piece 342 while the firing spring 360 is compressed.

By incorporating three locking lugs 322, 324, 326, the angular movement, X°, required to cycle the bolt handle 320 to cock the bolt action assembly 100 is reduced. For example, the angle of movement of the bolt handle 320 can be from about 40° to about 50°, and most preferably about 45°. The reduced amount of radial movement required to work the bolt action assembly 100 of the present teachings achieves a reduced overall cycling time of the action.

Pulling the trigger by the shooting competitor results in the release of the sear and in turn, releases the firing spring 360, which drives the offset firing pin 349 out of a hole in the bolt face and into the primer in the outer edge of the base of the rimfire cartridge. This impact detonates the primer which ignites the powder and discharges the round. Once the firing pin slide 340 has been released, it can remain uncocked until the bolt handle 320 is cycled again. To cycle the bolt action assembly 100, for example, the bolt handle 320 is rotated from the closed to the open position, the bolt assembly 300 is slid rearward until it engages a bolt stop (during this rearward movement the spent casing is ejected from the action), a new cartridge is inserted into the bolt action assembly 100, and the bolt assembly 300 is pushed forward (which inserts the new cartridge into the chamber of the barrel) until the bolt assembly 300 stops, at which time the bolt handle 320 is rotated from the open position to the closed position. The bolt action assembly 100 is then in a cocked and ready-to-fire position.

The firing of the cartridge subjects the bolt assembly 300 to enormous stress as gas pressure builds rapidly and expels the round from the barrel. The three rear locking lugs 322, 324, 326 of the bolt action assembly 100 of the present teachings operate to evenly distribute the bolt pressure over three large contact points at the rear portion of the receiver body 200. More particularly, the rear seating surfaces 334 of each of the three locking lugs 322, 324, 326 are forced to mate with the rear shoulder surface 214 of the lug groove 210 when the bolt assembly 300 is subjected to the high pressures created from the firing of a round. By evenly distributing the bolt pressure, the locking lugs 322, 324, 326 prevent longitudinal play as well as preventing whipping or flexing of the bolt assembly 300 within the receiver body 200. This will stop the bolt assembly 300 from moving up, down, or side-to-side in any way during the firing of a round.

Moreover, due to the firing pin slide 340 including an offset firing pin 349, the bolt assembly 300 will also experience a force that is shifted to one side if not supported properly. The three rear locking lugs 322, 324, 326 of the bolt action assembly 100 of the present teachings also operate to securely lock the bolt assembly 300 to the rear portion of the receiver body 200 thereby securely centering the bolt assembly 300 within the receiver body 200.

The three rear locking lugs 322, 324, 326 of the bolt action assembly 100 operate to lock the bolt assembly 300 into a position concentrically within the receiver body 200 and concentrically with a firearm barrel 400. This allows the axis of the bolt assembly 300 and of the firing pin slide 340 to remain parallel with the longitudinal axis of the central bore of the firearm barrel 400. Securely positioning the bolt assembly 300 also critically provides a perpendicular surface to evenly distribute the pressure of the bolt assembly 300 on the chambered round.

The movement of the bolt assembly 300 during the firing of a round is detrimental to the accuracy of the fired round and any movement of the bolt assembly 300 will affect its trajectory. The bolt action assembly 100 of the present teachings operates to evenly distribute the pressure the bolt assembly 300 experiences during the firing of the round and to reduce any vibrations and movement of the bolt assembly 300 within the receiver body 200. This allows consistent positioning of the components of the bolt action assembly 100 resulting in accurate, repeatable firing performance by the shooting competitor.

The components of the bolt action assembly 100 of the present teachings can be manufactured using both conventional and CNC type machine shop equipment. For example, the receiver body 200 can be manufactured from Type 416R stainless steel. For example, the bolt handle 320 can be manufactured from 4140HT alloy steel. The components of the bolt action assembly 100 of the present teachings can be machined to precise tolerances to assure proper alignment and fit with the mating pieces. Surfaces can be smooth with substantially no inclusions, blemishes, or scratches.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A bolt action assembly comprising:

a receiver body including a front aperture capable of receiving a firearm barrel and a rear aperture, a lug groove being formed in the vicinity of the rear aperture of the receiver body; and a bolt assembly including a bolt handle and three rear locking lugs arranged on a rear portion of the bolt assembly;

wherein the bolt assembly is configured to be arranged in the receiver body such that the three rear locking lugs are capable of being rotated within the lug groove when the bolt handle is rotated; and wherein when a round is fired the three locking lugs are forced to mate with the lug groove and evenly distribute a bolt pressure created by the firing of the round on a rear portion of the receiver body and three locking lugs lock the bolt assembly into a position concentrically within the receiver body and concentrically with the firearm barrel to provide accurate and repeatable firing performance.

2. The bolt action assembly of claim 1, wherein the bolt assembly is a rimfire bolt assembly.

3. The bolt action assembly of claim 1, wherein the lug groove defines a rear shoulder surface and each of the three rear locking lugs defines a rear seating surface which are capable of mating with and being forced against the rear shoulder surface when a round is fired to evenly distribute a bolt pressure on the receiver body.

4. The bolt action assembly of claim 1, wherein the three rear locking lugs are arranged equidistantly about a circumference of the rear portion of the bolt assembly.

5. The bolt action assembly of claim 4, wherein the bolt assembly includes more than three rear locking lugs arranged equidistantly about a circumference of the rear portion of the bolt assembly.

6. The bolt action assembly of claim 1, wherein a rear portion of the receiver body includes three lug raceways arranged to allow the three rear locking lugs of the bolt assembly to be inserted into engagement with the lug groove of the receiver body.

7. The bolt action assembly of claim 1, wherein the bolt handle can be rotated from a fully open position to a fully closed, cocked position by rotating the bolt handle 50° or less.

8. A rear lock-up bolt action assembly comprising:

a receiver body including a lug groove being formed in the vicinity of a rear portion of the receiver body, the lug groove defining a rear shoulder surface; and a bolt assembly including a bolt handle and at least three rear locking lugs arranged on a rear portion of the bolt assembly, each of the at least three rear locking lugs defining a rear seating surface;

wherein each of the three rear locking lugs are arranged to lock the bolt assembly into a position concentrically within the rear portion of the receiver body; and wherein the bolt assembly is configured to be supported in the receiver body such that when a round is fired the rear seating surfaces of each of the three rear locking lugs are forced to mate with the rear shoulder surface of the lug groove thereby evenly distributing a bolt pressure on a rear portion of the receiver body and prevent longitudinal play and whipping and flexing of the bolt assembly within the receiver body to provide accurate and repeatable firing performance.

9. The rear lock-up bolt action assembly of claim 8, wherein the bolt assembly is a rimfire bolt assembly.

10. The rear lock-up bolt action assembly of claim 8, wherein the three rear locking lugs are arranged equidistantly about a circumference of the rear portion of the bolt assembly.

11. The rear lock-up bolt action assembly of claim 10, wherein the bolt assembly includes more than three rear locking lugs arranged equidistantly about a circumference of the rear portion of the bolt assembly.

12. The rear lock-up bolt action assembly of claim 8, wherein a rear portion of the receiver body includes three lug raceways arranged to allow the three rear locking lugs of the bolt assembly to be inserted into engagement with the lug groove of the receiver body.

13. The rear lock-up bolt action assembly of claim 8, wherein the bolt handle can be rotated from a fully open position to a fully closed, cocked position by rotating the bolt handle about 50° or less.

14. A rear lock-up rimfire bolt action assembly comprising:

a receiver body including a lug groove being formed in the vicinity of a rear portion of the receiver body; and a bolt assembly including an offset firing pin, a bolt handle, and at least three rear locking lugs arranged on a rear portion of the bolt assembly;

wherein the bolt assembly is configured to be supported in the receiver body such that when a rimfire cartridge is fired the three rear locking lugs (i) are forced to mate with the lug groove thereby evenly distributing a bolt pressure created by the firing of the rimfire cartridge on the rear portion of the receiver body and (ii) prevent longitudinal play and whipping and flexing of the bolt assembly within the receiver body;

wherein the three locking lugs securely lock the bolt assembly to the rear portion of the receiver body to center the bolt assembly within the receiver body to counteract a shifted force created due to the firing of the rimfire cartridge using the offset firing pin.

15. The rear lock-up rimfire bolt action assembly of claim 14, wherein the lug groove defines a rear shoulder surface and each of the three rear locking lugs defines a rear seating surface which are capable of being forced against and mate with the rear shoulder surface when the rimfire cartridge is fired.

16. The rear lock-up rimfire bolt action assembly of claim 14, wherein the three rear locking lugs are arranged equidistantly about a circumference of the rear portion of the bolt assembly.

17. The rear lock-up rimfire bolt action assembly of claim 16, wherein the bolt assembly includes more than three rear locking lugs arranged equidistantly about a circumference of the rear portion of the bolt assembly.

18. The rear lock-up rimfire bolt action assembly of claim 14, wherein a rear portion of the receiver body includes three lug raceways arranged to allow the three rear locking lugs of the bolt assembly to be inserted into engagement with the lug groove of the receiver body.

19. The rear lock-up rimfire bolt action assembly of claim 14, wherein the bolt handle can be rotated from a fully open position to a fully closed, cocked position by rotating the bolt handle 50° or less.

20. The rear lock-up rimfire bolt action assembly of claim 14, wherein the lug groove can include a substantially rectangular cross-section into which the three rear locking lugs can rotationally slide within.

* * * * *